US008646388B1

(12) United States Patent
Bradbury

(10) Patent No.: US 8,646,388 B1
(45) Date of Patent: Feb. 11, 2014

(54) BROADHEAD BULLET

(71) Applicant: Michael Sean Bradbury, Eagle, CO (US)

(72) Inventor: Michael Sean Bradbury, Eagle, CO (US)

(73) Assignee: Michael S. Bradbury, Eagle, CO (US)

( * ) Notice: Subject to any disclaimer, the term of this patent is extended or adjusted under 35 U.S.C. 154(b) by 0 days.

(21) Appl. No.: 13/621,592

(22) Filed: Sep. 17, 2012

(51) Int. Cl.
*F42B 30/02* (2006.01)

(52) U.S. Cl.
USPC ..... 102/400; 102/520

(58) Field of Classification Search
USPC ..... 102/400, 439, 501, 502, 504, 512, 517, 102/520, 521, 522
See application file for complete search history.

(56) References Cited

U.S. PATENT DOCUMENTS

| | | | | | |
|---|---|---|---|---|---|
| 269,101 | A | * | 12/1882 | Palliser | 102/517 |
| 1,063,905 | A | * | 6/1913 | Beckmann | 102/519 |
| 1,099,784 | A | * | 6/1914 | Bizas | 102/400 |
| 1,136,480 | A | * | 4/1915 | O'Rawe | 102/400 |
| 1,139,916 | A | * | 5/1915 | Stoehr et al | 102/400 |
| 1,144,818 | A | * | 6/1915 | Damer | 102/400 |
| 1,152,668 | A | * | 9/1915 | Sullivan | 102/400 |
| 1,204,950 | A | * | 11/1916 | Crane | 102/400 |
| 1,205,715 | A | * | 11/1916 | Damer | 102/400 |
| 1,225,497 | A | * | 5/1917 | Rodzikevitch | 102/430 |
| 1,318,858 | A | * | 10/1919 | Frick | 102/400 |
| 1,330,291 | A | * | 2/1920 | Witkowski et al. | 102/400 |
| 2,014,367 | A | * | 9/1935 | Breegle | 102/436 |
| 2,661,694 | A | | 5/1950 | Allen et al. | |
| 3,893,866 | A | * | 7/1975 | Hollingsworth | 473/581 |
| 4,334,657 | A | * | 6/1982 | Mattson | 244/3.28 |
| 4,408,538 | A | * | 10/1983 | Deffayet et al. | 102/522 |
| 4,644,866 | A | * | 2/1987 | Sullivan | 102/439 |
| 4,729,320 | A | * | 3/1988 | Whitten, III | 102/371 |
| 4,976,443 | A | * | 12/1990 | DeLucia | 473/583 |
| 5,020,438 | A | * | 6/1991 | Brown | 102/517 |
| 5,066,021 | A | * | 11/1991 | DeLucia | 473/583 |
| 5,078,407 | A | | 1/1992 | Carlston | |
| 5,116,224 | A | * | 5/1992 | Kelsey, Jr. | 102/439 |
| 5,133,261 | A | * | 7/1992 | Kelsey, Jr. | 102/439 |
| 6,234,082 | B1 | * | 5/2001 | Cros et al. | 102/520 |
| 6,240,849 | B1 | | 6/2001 | Holler | |
| 6,439,127 | B1 | * | 8/2002 | Cherry | 102/519 |
| 6,571,715 | B1 | * | 6/2003 | Bennett et al. | 102/439 |
| 6,588,700 | B2 | * | 7/2003 | Moore et al. | 244/3.28 |
| 7,178,462 | B2 | | 2/2007 | Beasley | |

* cited by examiner

*Primary Examiner* — Jonathan C Weber

(57) ABSTRACT

A new type of firearm projectile incorporating the functionality of a pivoting blade broad head with that of a firearm propelled projectile. The Broadhead Bullet is for use in shorter ranges akin to bow hunting ranges but able to utilize the cost effectiveness and utility of existing firearm platforms that can accommodate the caliber of the Broadhead Bullet.

9 Claims, 7 Drawing Sheets

BROADHEAD BULLET

CROSS-REFERENCE TO RELATED APPLICATION

Figure 3:
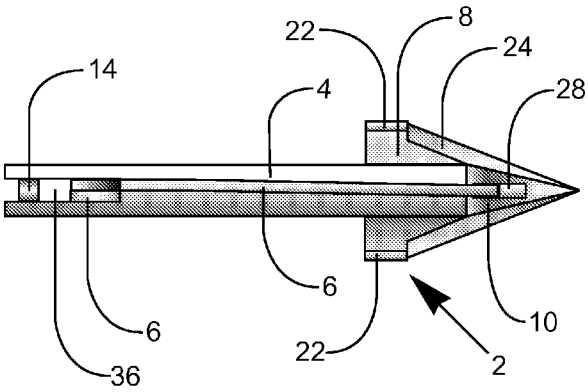

This application is entitled to the benefit of Provisional Patent Application Ser. No. 61/685,006 filed Mar. 10, 2012 and Provisional Patent Application Ser. No. 61/641,284 filed May 1, 2012.

FEDERALLY SPONSORED RESEARCH

Not Applicable

SEQUENCE LISTING OR PROGRAM

Not Applicable

BACKGROUND OF INVENTION

1. Field of Invention

This invention relates to firearm projectiles, more specifically a firearm projectile that combines the functionality of a retractable broad head arrowhead with that of a shotgun shell intended for use with smoothbore shotguns of a specific caliber.

Objects and Advantages

The advantages of the Broadhead Bullet are as follows:

To produce a firearm fired projectile that does not rely upon a rifled barrel for stabilization but rather in flight stabilization dependant upon airflow through its own construction and design.

To produce a sub-sonic firearm projectile that produces a much smaller noise signature than traditional supersonic firearm projectiles for discrete hunting.

To produce a low kinetic energy firearm projectile for use in a smoothbore firearm that can successfully be use for hunting large game such as deer and elk.

For the circular sabot Broadhead Bullet, to produce a firearm fired projectile with a sabot that separates into at least two pieces upon impact and does not release until the projectile enters the target. This feature eliminates the destabilizing force associated with a sabot that releases in mid-flight and thus necessitates the projectile to be dependant upon centrifugal force for stabilization.

For the blade sabot Broadhead Bullet to produce a projectile for use with a smoothbore barrel, the Bullet to utilize four separate sabots each attached to an outside edge of blade. The sabots guide the pivoting blades into deployment stage and eject from the blades as the Bullet enters the target medium.

To produce a firearm projectile that mimics the performance of a broad head arrow fired from a compound bow.

To produce an expandable broad head projectile that creates a wound channel that is significantly larger than conventional broad heads on the market.

To create a bow hunting experience but with a firearm rather than expensive and difficult to use compound bows.

To produce a low kinetic energy subsonic hunting round that can be used in a smoothbore barreled firearm that would function within the firearm's action, as would ammunition for the same currently on the consumer market without modification to the function of the firearm.

To produce a sabot projectile that does not rely upon rifled barrels and centrifugal force for the projectiles stabilization.

2. Prior Art

The use of projectiles for big game hunting has been a unique method of hunting for mankind since the beginning written history. Mankind's ingenuity has perfected the firearm projectile into a highly effective hunting tool, specifically discussed here are the methods of hunting utilizing a bow and arrow and also that of the firearm and bullet. Both methods deliver a greatly enhanced method of harvesting meat via hunting and both methods offer their own advantages and disadvantages when compare to the other method of hunting discussed here. Unfortunately neither method it compatible with each other, both methods needs to be immersed within its own discipline with both the strategy and with equipment used to hunt. There have been attempts in the past to incorporate the advantages of both methods of hunting, bow and arrow and gun and bullet, but all have failed to bring a significantly superior product to the consumer market as their designs lack functionality, are too costly, do not perform well, or just plain do not work. The following are descriptions of prior art and discussions as to why these products have not been successful.

U.S. Pat. No. 1,318,858 was issued to John Frick for an expansible projectile for use in firearms and the like. Frick's invention has "outwardly projecting arms or cutting blades which are automatically positioned either due to the force of explosion or by the impact of the projectile against an object." Unfortunately Frick's invention utilizes a complex arrangement to deploy his blades including a plunger. This construction and operation of his expansible projectile make it expensive and too difficult to implement in a practical manner. The plunger style orientation for deploying the blades is also not reliable, as any variation of impact may not activate the plunger correctly. Frick's projectile also does not utilize a sabot to protect his blade while traveling the length of the firearm barrel thus allowing for destabilizing forces to disrupt the intended trajectory. The present invention is intended for use in a firearm with a smoothbore barrel such as a 12-gauge shotgun. The Broadhead Bullet relies upon a sabot or several blade mounted sabots to accurately guide it though the length of the firearm barrel.

U.S. Pat. No. 2,661,694 was issued to James Allen and William Cantrell for the Spreader Panel Bullet that "spread laterally upon impact with an object". As with Frick's invention the Spreader Panel Bullet does not incorporate a sabot to encase the projectile thus necessitating the blades and its supporting mechanisms to be encase within the projectile. This configuration is too complicated and expensive for the projectile to be except in specialty situations. The blades also are not connected to the projectile and only deploy in a forward swept position thus severely hindering its damaging potential, as this design would quickly slow the projectile as it enters the target medium. The blades would be subject to ejection from the projectile causing unpredictable performance. The supporting mechanisms for deploying the blades are complicated and therefore would be expensive and difficult to implement. The present invention utilizes a much simpler and more effective design and would thus be less expensive and yield better performance.

U.S. Pat. No. 5,078,407 was issued to Marvin Carlston for his Expandable Blade, Composite Plastic, and Broadhead Hunting Arrow Tip. Carlston here describes the use of "rotatable blades which are trunnion mounted securely in the body of the tip, and which are designed to be partially exposed while in flight". Carlston describes the function of the blades as being able to "rotate into an expanded position upon impact" and "the blades are mounted in a forward position with the tips of the blades protruding outside of the tip body". Carlston's design is one of simplicity and functionality and has been proven successful in the marketplace. Carlston's invention however is designed for bow hunting and is not for use with firearms, therefore it does not have any relevance to the present invention.

U.S. Pat. No. 6,240,849 was awarded to Christopher Holler for the Projectile with Expanding Members. Holler's invention has "open-biased arm members" that are "compressed into a restrained position" before firing the bullet. When the bullet is fired "the arms extend to the unrestrained position" which then catch the target material and slow the projectile down. Holler's invention is for a projectile suited for use in a rifled barrel and not a smooth bore shotgun as it relies upon centrifugal force for stabilization. Also his arms extend when the projectile is fired and not upon impact thus creating a massive amount of drag upon the projectile thus making it grossly inefficient as a projectile. Holler's projectile unfortunately may not be a feasible working projectile as it has many lacking characteristics that prevent it from becoming a workable firearm projectile.

U.S. Pat. No. 7,178,462 was awarded to Beasley for the Projectile with Members that Deploy Upon Impact. Beasley's projectile relies upon a "nose piece that shears off upon impact with the target, causing the nose piece to be pushed inside the projectile". The "nose piece pushes on members that deploy outwardly and lock into place, thereby greatly increasing the damage done to the target". Beasley's invention, much like Holler's, is a projectile intended for use within a rifled barrel and not a smoothbore barrel as it relies upon centrifugal force for stabilization of the projectile. Beasley's members or blades reside inside of the projectile and require an intricate mechanical arrangement for the deployment of the blades. Also the members or blades are unfortunately restricted in size due to the stowing of the blades within the bullet thus the members are also severely restricted in the amount of damage the can inflict upon the target. In all Beasley's projectile is complicated in use and construction and offers minimal advantage for the members to inflict damage therefore the concept has minimal value for its intended purpose.

REFERENCE NUMERALS

2. Broadhead Bullet assembly
4. Shaft
6. Pivoting Blade
8. Stationary blade
10. Stationary blade scoop
12. Blade pivot
14. Blade stop
18. Pivoting Blade tip
20. Wad-sabot
22. Stationary blade sabot
24. Stationary blade edge
26. Circular sabot
28. Pivoting blade sabot
30. Pivoting blade edge
32. Pivoting blade sabot recess
34. Broadhead Bullet alternate embodiment
38. Shotgun shell
40. Powder charge
42. Target material
44. Gun barrel

ILLUSTRATIONS

Figure 1:
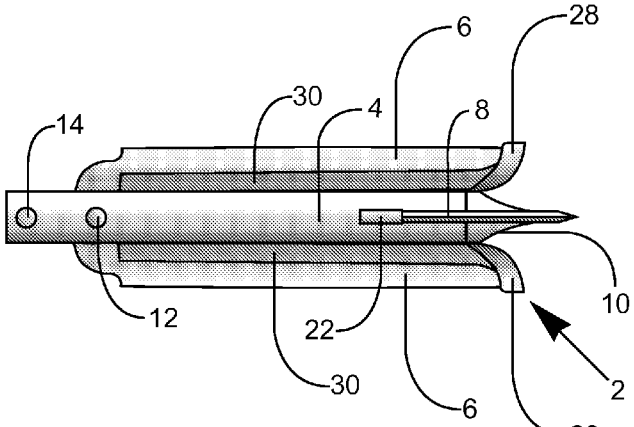

FIG. 1 details a side view of the Broadhead Bullet in flight with the pivoting blades in the closed position.

Figure 2:
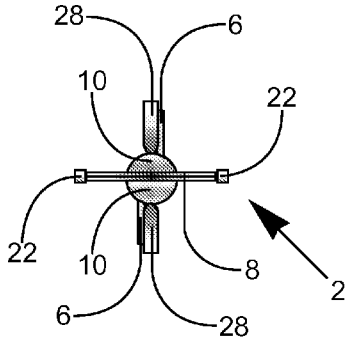

FIG. 2 details a front view of the Broadhead Bullet from FIG. 1.

FIG. 3 details an alternate side view of the Broadhead Bullet from FIG. 1, the Broadhead Bullet is rotated 90 degrees on its horizontal axis.

Figure 4:
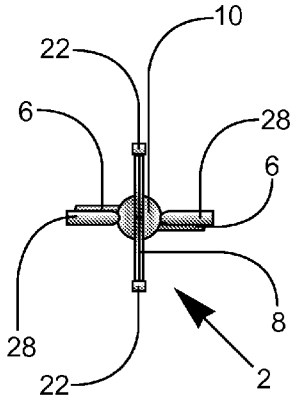

FIG. 4 details a front view of the Broadhead Bullet from FIG. 3.

Figure 5:
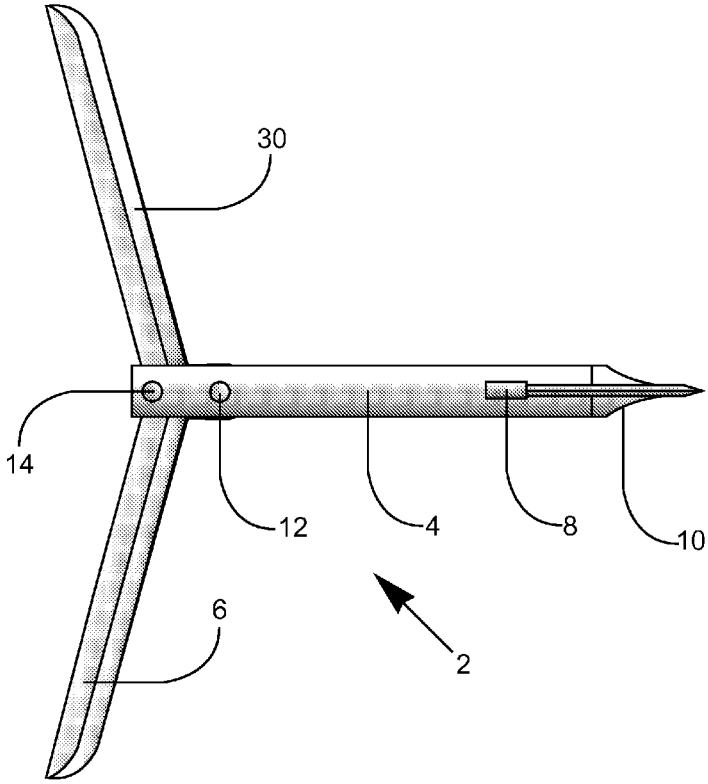

FIG. 5 details a side view of the Broadhead Bullet with the pivoting blades in the fully deployed position.

Figure 6:
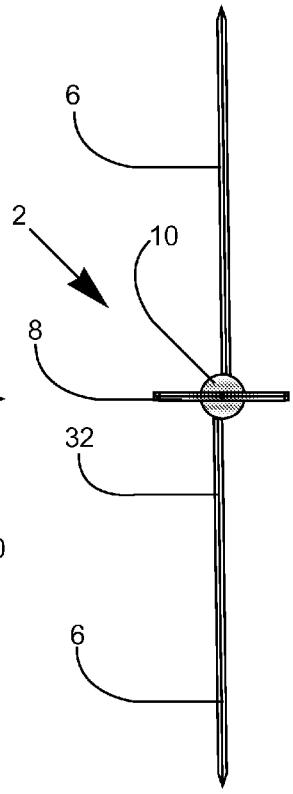

FIG. 6 details a front view of the Broadhead Bullet from FIG. 5.

Figure 7:
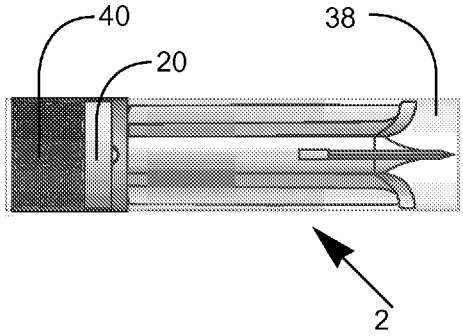

FIG. 7 details the Broadhead Bullet assembly inside of a shot shell; the shot shell is semi-transparent to view the Broadhead Bullet and accompanying assembly components.

Figure 8:
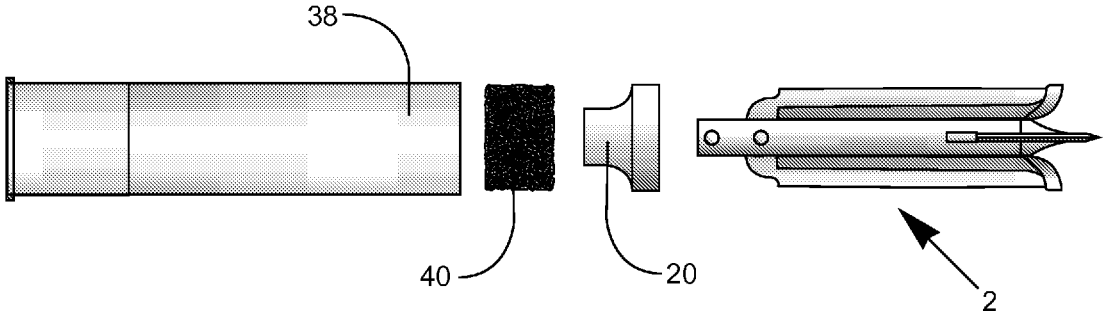

FIG. 8 details the Broadhead Bullet and accompanying assembly components in an exploded view.

Figure 9:
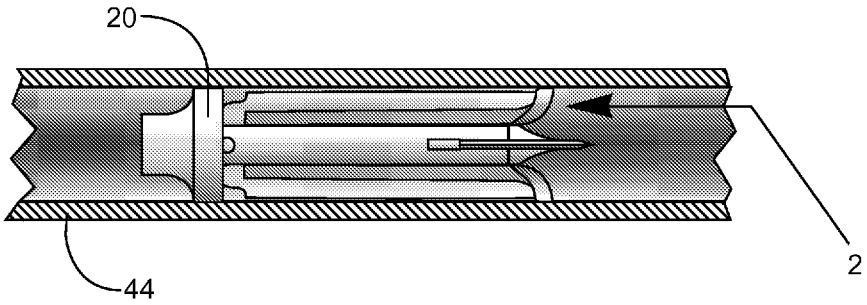

FIG. 9 is a cut-a-way view of a shotgun barrel with the Broadhead Bullet inside.

Figure 10:
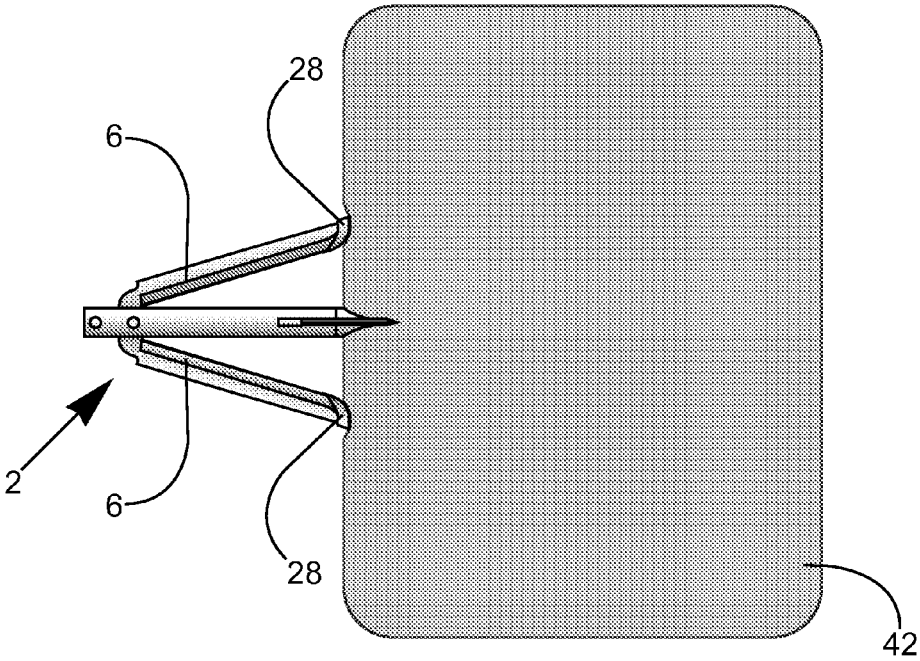

FIG. 10 details the Broadhead Bullet as it strikes the target material, the pivoting blades in semi-deployment position.

Figure 11:
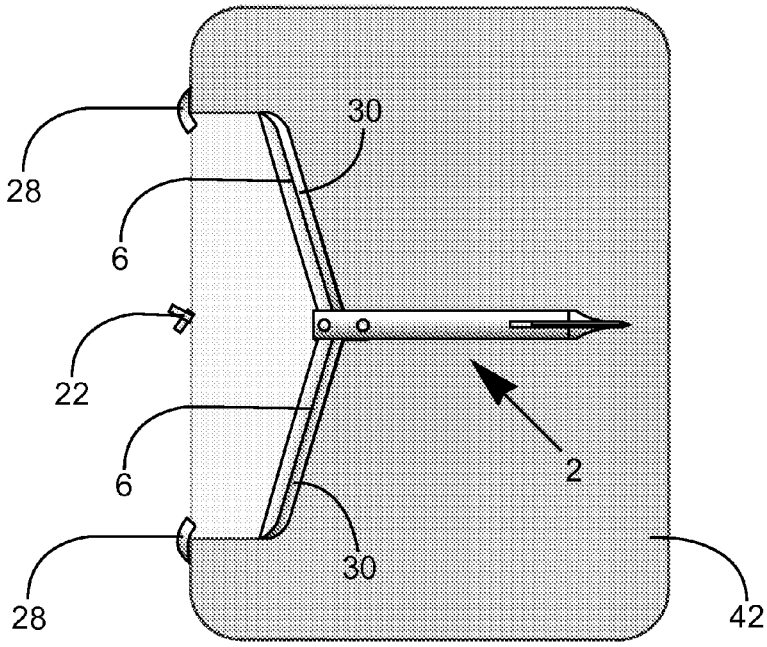

FIG. 11 details the Broadhead Bullet inside the target material; the pivoting blades in full deployment position, the pivoting blade and stationary blade sabots are ejected from the Broadhead Bullet assembly.

Figure 12:
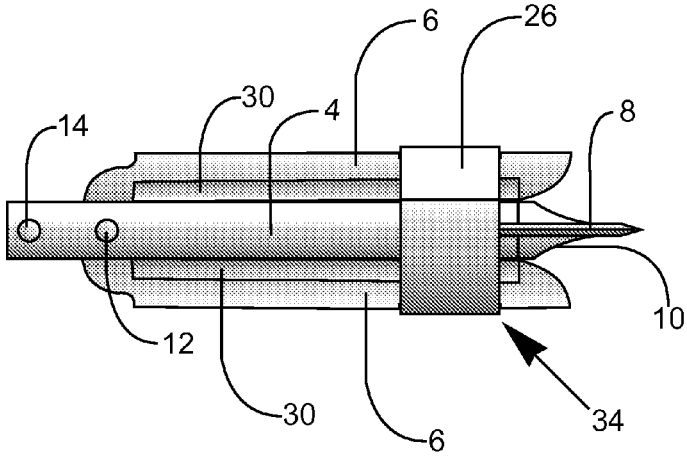

FIG. 12 details a side view of the Broadhead Bullet with the circular sabot.

Figure 13:
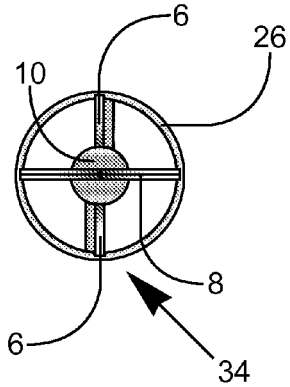

FIG. 13 details a front view of the Broadhead Bullet from FIG. 12.

Figure 14:
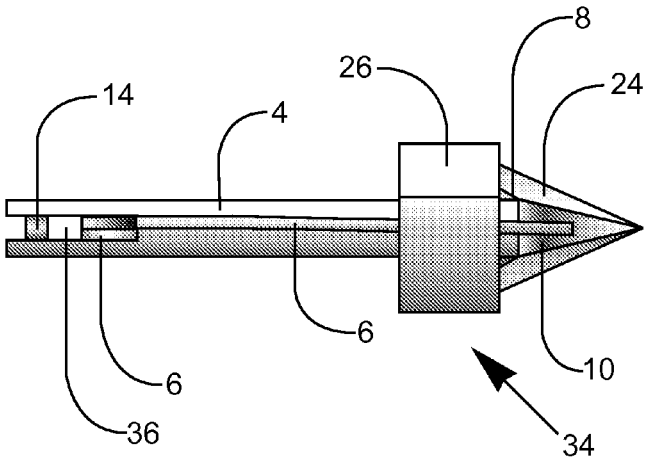

FIG. 14 details an alternate side view of the Broadhead Bullet from FIG. 12, the Broadhead Bullet is rotated 90 degrees on its horizontal axis.

Figure 15:
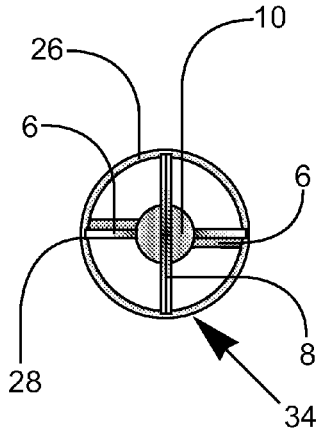

FIG. 15 details a front view of the Broadhead Bullet from FIG. 14.

Figure 16:
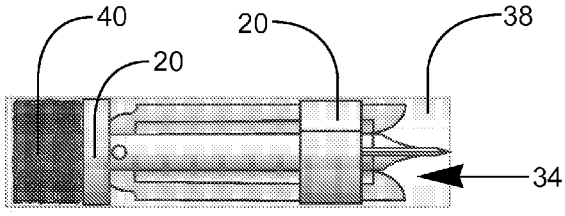

FIG. 16 details the Broadhead Bullet assembly with a sabot inside of a shot shell; the shot shell is semi-transparent to view the Broadhead Bullet and accompanying assembly components.

Figure 17:
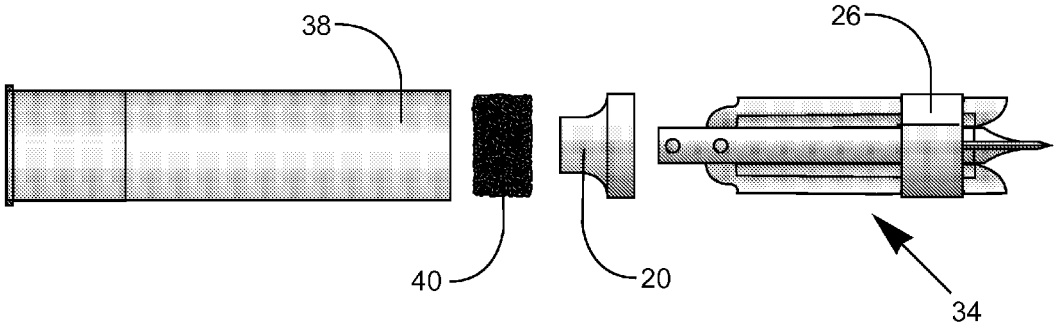

FIG. 17 details the Broadhead Bullet with a circular sabot and accompanying assembly components in an exploded view.

Figure 18:
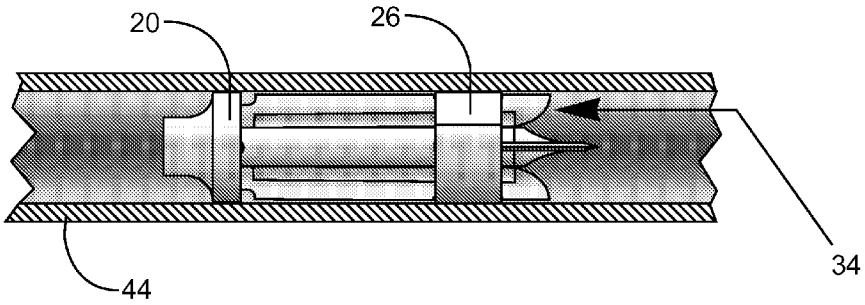

FIG. 18 is a cut-a-way view of a shotgun barrel with the Broadhead Bullet with a circular sabot inside.

Figure 19:
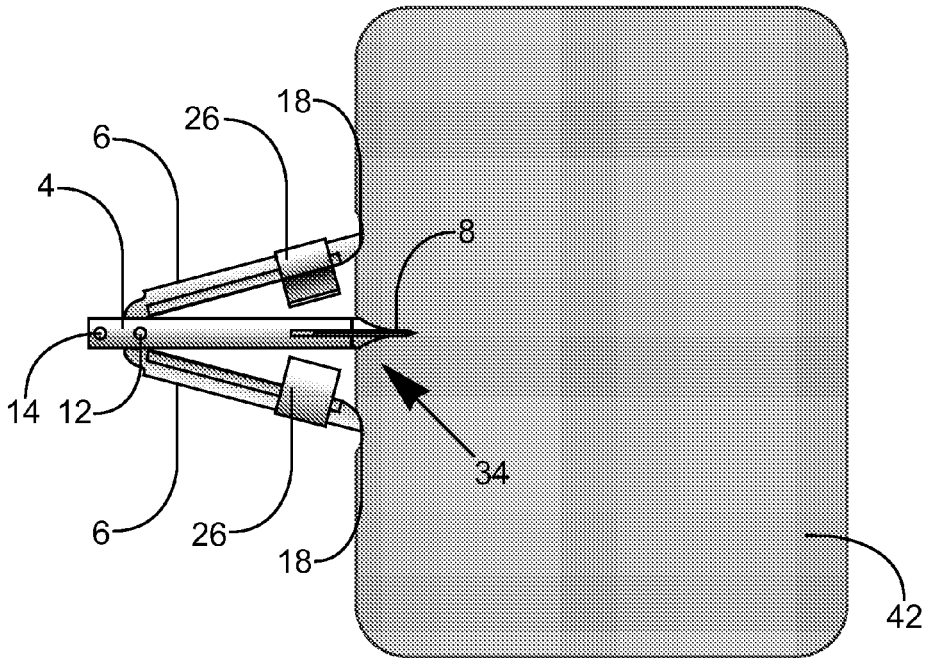

FIG. 19 details the Broadhead Bullet with the circular sabot as it strikes the target material. Here the pivoting blades are in the semi-deployment position with the circular sabot separating into two and remaining attached to the pivoting blades.

Figure 20:
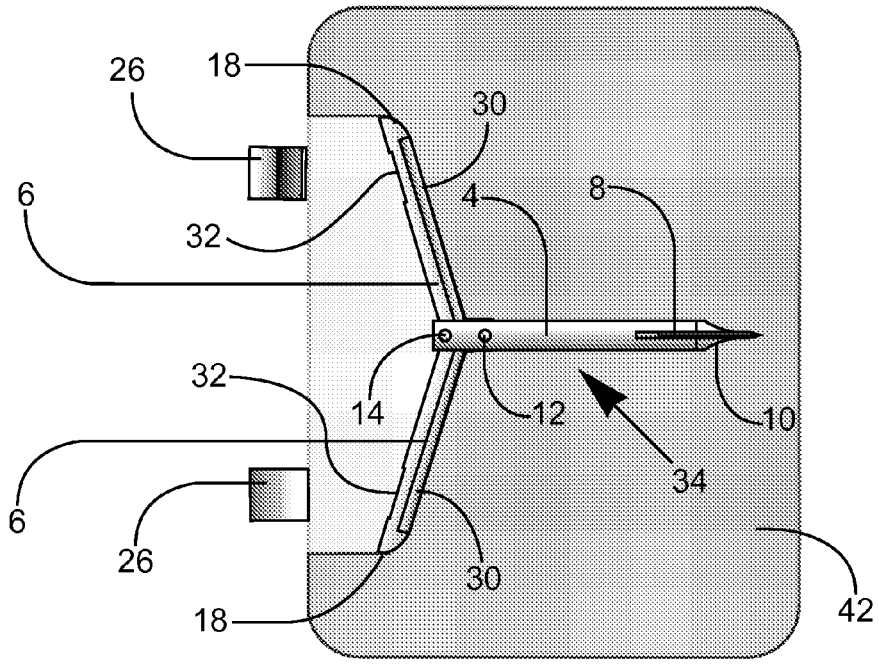

FIG. 20 details the Broadhead Bullet with the circular sabot inside the target material. Here the pivoting blades are in full deployment position, the circular sabot pieces are ejected from the pivoting blades.

DESCRIPTION

Preferred Embodiment FIGS. 1-11

The Broadhead Bullet assembly 2 is illustrated in FIGS. 1-11. The Broadhead Bullet is intended to function within a 12-gauge shotgun with a smooth bore barrel, as would current 12-gauge shot shells for smooth bore barrels on the consumer market today. FIG. 1-4 details the Broadhead Bullet assembly 2 in the in flight mode with the pivoting blades 6 in their closed position. Here the pivoting blades 6 are rotated forward on the blades 6 blade pivot 12 and the blade edges 30 rests on or near the Broadhead Bullets 2 shaft 4 while pivoting blade sabots 28 reside at the forward most position of the blades 6. The pivoting blades 6 front tips are centralized at the front of the assembly such that the tips are in alignment with the central horizontal axis of the shaft 4. The rear end of the pivoting blades 6 are attached to the blade pivot 12 where both pivoting blades 6 reside side by side on the blade pivot 12. This construction allows for a slight angular bias between the rear and front ends of the pivoting blades 6. Fixed Blades 8 reside at 90 degrees from either of the pivoting blades 6 position on shaft 4.

Stationary blade sabots 22 are attached to the outer most edge of the stationary blades 8 and are constructed from a plastic like material that will not damage the inside surface of the firearm barrel as well as to provide a contact surface with the characteristic of having less friction than would the stationary blade produce against the firearm barrel. Pivoting blade sabots 28 are attached to the outer and forward most position of the pivoting blades 6 and are also constructed from a plastic like material that will not damage the inside surface of the firearm barrel as well as to provide a contact surface with the characteristic of having less friction than would the pivoting blades produce against the firearm barrel. Both the stationary blade sabots 22 and pivoting blade sabots 28 provide a barrier between both the stationary blades 8 and the pivoting blades 6 and the inside surface of the firearm barrel such that the assembly 2 will not experience any sizable gap between the sabots 22, 28 and the firearm barrel thus eliminating any vibrational disruption in the trajectory of the assembly 2.

FIG. 5 shows a side view and FIG. 6 shows a front view of the Broadhead Bullet with the pivoting blades 6 in full deployment stage. Here pivoting blade edges 30 now face forward of the Broadhead Bullet 2. The pivoting blades 6 at the blade pivot 12 are positioned side by side thus aligning the bases of the pivoting blades 6 off center from the central horizontal axis of the shaft 4. This construction allows for a slight angular bias between the rear and front ends of the pivoting blades. The pivoting blades 6 in the fully deployed stage rest against blade stop 14 in such a way the blade stop 14 stops the pivoting deployment action of the pivoting blades 6 as well as to provide a strengthened rest to support the pivoting blades 6.

FIG. 7 shows the Broadhead Bullet 2 inside of a shotgun shell 38, as it would be before being shot. The shotgun shell 38 here is semi transparent to better illustrate the construction of the Broadhead Bullet 2 within the shot shell. Here the shell 38 contains powder charge 40, wad-sabot 20, and the Broadhead Bullet 2.

FIG. 8 shows an exploded view of the Broadhead Bullet 2 with the shot shell 38, powder charge 40, Wad-sabot 20, and Broadhead Bullet 2.

FIG. 9 shows a cut-a-way view of a shotgun barrel 44 with the Broadhead Bullet assembly 2 and wad-sabot 20, as they would be after firing the round from the shotgun shell 38. Here the stationary blade sabots 22, pivoting blade sabots 28, and the wad-sabot 20 are all connected to the Broadhead Bullet 2 and are in contact with the gun barrel 44 in a manner that will not allow the pivoting blades 6 and stationary blades 8 to contact the gun barrel 44.

FIG. 10 shows the Broadhead Bullet 2 in the early stages of striking the target material 42, the pivoting blade sabots 28 are in contact with the material 42 as well as the stationary blades 2 and stationary blade scoop 10. The pivoting blades 6 are in the early deployment stage.

FIG. 11 shows the Broadhead Bullet 2 as the entire assembly enters the target material 42 minus the pivoting blade sabots 28 and stationary blade sabots 22 which are ejected from the pivoting blades 6 and stationary blades 8 respectively. The stationary blades 8, pivoting blades 6, and stationary blade scoop 10 cut a path through the target material 42 as the Broadhead Bullet 2 travels through the target material 42.

Operation of Invention: FIGS. 1-11

The Broadhead Bullet assembly 2 is illustrated in FIGS. 1-11. The Broadhead Bullet is intended to function within a 12-gauge shotgun with a smoothbore barrel, as would current 12-gauge shotgun shells for smooth bore barrels on the consumer market today. FIG. 1-4 details the Broadhead Bullet assembly 2 in the in flight with the pivoting blades 6 in their closed position. Here the pivoting blades 6 are rotated forward on the blades 6 blade pivot 12 and the blade edges 30 rests on or near shaft 4 while pivoting blade sabots 28 reside at the forward most position of the blades 6. The pivoting blades 6 front tips are positioned at the front of the assembly 2 such that the tips are in alignment with the central horizontal axis of the shaft 4. The rear end of the pivoting blades 6 are attached to the blade pivot 12 where both pivoting blades 6 reside side by side on the blade pivot 12. This construction allows for a slight angular bias between the rear and front ends of the pivoting blades 6. This angular bias will impart a rotational force to the Broadhead Bullet 2 during its trajectory by directing the air around the pivoting blades 6 thus imparting a resistance to the Bullet 2 to spin around its central horizontal axis. This spin will create a more stable flight trajectory for the Broadhead Bullet 2 as would the spin a traditional bullet fired from a rifled barrel would stabilize the round. Fixed Blades 8 reside at 90 degrees from either of the pivoting blades 6 position on shaft 4 and may also have an angular bias such as to impart a rotational force to the Broadhead Bullet 2.

Stationary blade sabots 22 are attached to the outer most edge of the stationary blades 8 and are constructed from a plastic like material that will not damage the inside surface of the firearm barrel as well as to provide a contact surface with the characteristic of having less friction than would the stationary blade produce against the firearm barrel. Pivoting blade sabots 28 are attached to the outer and forward most position of the pivoting blade 6 and are also constructed from a plastic like material that will not damage the inside surface of the firearm barrel as well as to provide a contact surface with the characteristic of having less friction than would the pivoting blades produce against the firearm barrel. Pivoting blade sabots 28 may have an airfoil design to impart a low drag characteristic or an airflow bias to the pivoting blades 6 thus aiding the Broadhead Bullet 2 to maintain its velocity and rotational spin.

Both the stationary blade sabots 22 and pivoting blade sabots 28 provide a barrier between both the stationary blades 8 and the pivoting blades 6 respectfully and the inside surface of the firearm barrel such that the Broadhead Bullet 2 will not experience any sizable gap between the sabots 22, 28 and the gun barrel 44 thus eliminating any vibration disruption at it travels through the gun barrel 44.

FIG. 7 shows the Broadhead Bullet 2 inside of a shotgun shell 38, as it would be before being shot. The shotgun shell 38 here is semi transparent to better illustrate the construction of the Broadhead Bullet 2 within the shotgun shell 38. Here the shell 38 contains powder charge 40, wad-sabot 20, and the Broadhead Bullet 2.

FIG. 8 shows an exploded view of the Broadhead Bullet 2 with the shotgun shell 38, powder charge 40, Wad-sabot 20, and Broadhead Bullet 2.

FIG. 9 shows a cut-a-way view of a gun barrel 44 with the Broadhead Bullet assembly 2 and wad-sabot 20, as they would be after firing the round from the shotgun shell 38. Here the stationary blade sabots 22, pivoting blade sabots 28, and the wad-sabot 20 are all connected to the Broadhead Bullet 2 and are in contact with the gun barrel 44 in a manner that will not allow the pivoting blades 6 and stationary blades 8 to contact the gun barrel 44.

When the Broadhead Bullet 2 is fired, the primer ignites the powder charge 40 after the primer is struck by the guns firing pin. As the powder 40 burns the expanding gasses produced pushes the wad-sabot 20 against the Broadhead Bullet 2, which is in turn pushed out of the shell 38 and into the gun barrel 44. During this stage the wad-sabot 20, pivoting blade sabots 28, and stationary blade sabots 22 guides the Broadhead Bullet 2 through the firearm barrel 44 providing a stabilizing travel while preventing the pivoting blades 6 and stationary blades 8 from contacting the gun barrel 44. As the Broadhead Bullet 2 exits the firearm barrel 44 the wad-sabot 20 is ejected from the Broadhead bullet 2 leaving only the Bullet 2, pivoting blade sabots 28, and stationary blade sabots 22 on its intended trajectory towards the target.

The Broadhead Bullet 2 here mimics the trajectory of an arrow fired from a high-powered compound bow, depending on the size of the powder charge 40. This intended trajectory for the Broadhead Bullet 2 thus allows for it to be used in areas where the type of projectile is limited to short ranges due to high-density area hunting. The Broadhead Bullet 2 is intended for use in one of the most popular firearms, the 12-gauge shotgun, without modifications to the shotgun. A sighting system specifically calibrated to the trajectory of the Broadhead Bullet 2 may be incorporated to compensate for the shortened travel of the Bullet 2.

FIG. 10 shows the Broadhead Bullet 2 in the early stages of striking the target medium 42, the pivoting blade sabots 28 are in contact with the medium 42 as well as the stationary blades 2 and stationary blade scoop 10. As the shaft 4, blade scoop 10, and stationary blades 8 travel through the target material 42 the pivoting blade sabots 28 catch the target material 42 preventing the pivoting blades 6 from penetrating the target material 42. The pivoting blade sabots 28 slide along the external surface of the target material and away from the central horizontal axis of the shaft 4, which deploys the pivoting blades 6 into the open position. FIG. 10 shows the pivoting blades 6 in the early stages of pivoting blade 6 deployment. FIG. 11 shows the Broadhead Bullet 2 as the entire assembly has entered the target material 42 minus the pivoting blade sabots 28 and stationary blade sabots 22 which are ejected from the pivoting blades 6 and stationary blades 8 respectively. The pivoting blades 6 have fully deployed and rest against blade stop 14 in such a way the blade stop 14 stops the pivoting deployment action of the pivoting blades 6 as well as to provide a strengthened rest to support the pivoting blades 6. The stationary blades 8, pivoting blades 6, and stationary blade scoop 10 cut a path through the target medium 44 as the Broadhead Bullet 2 travels through the target material 42.

DESCRIPTION

Alternate Embodiment FIGS. 12-20

The Broadhead Bullet alternate embodiment 34 is illustrated in FIGS. 12-20. The Broadhead Bullet alternate embodiment 34 is intended to function within a 12-gauge shotgun with a smooth bore barrel, as would current 12-gauge shot shells for smooth bore barrels on the consumer market today. FIGS. 12-15 details the Broadhead Bullet alternate 34 in the in flight mode with the pivoting blades 6 in their closed position. Here the pivoting blades 6 are rotated forward on the blades 6 blade pivot 12 and the blade edges 30 rest on or near the shaft 4. Pivoting blade tips 18 are centralized at the front of the Broadhead Bullet alternate 34 such that the tips 18 are in alignment with the central horizontal axis of the shaft 4. The rear end of the pivoting blades 6 are attached to the blade pivot 12 where both pivoting blades 6 reside side by side on the blade pivot 12. This construction allows for a slight angular bias between the rear and front ends of the pivoting blades 6. Fixed Blades 8 reside at 90 degrees from either of the pivoting blades 6 position on shaft 4.

The circular sabot 26 is constructed from two separate and identical pieces and is attached to the pivoting blades sabot recess 32 portion of the pivoting blades 6 and contact the stationary blades 8 such that the stationary blades 8 provide structural support to the sabot 26 during firing and in flight. The circular sabot 26 pieces are constructed from a plastic like material that will not damage the inside surface of the gun barrel 44 as well as to provide a contact surface with the characteristic of having less friction than would the stationary 8 and pivoting 6 blades would produce against the gun barrel 44. The circular sabot 26 and wad-sabot 20 provides a barrier between both the stationary blades 8 and the pivoting blades 6 and the inside surface of the gun barrel 44 such that the alternate assembly 34 will not experience any sizable gap between the sabot 26, wad-sabot-sabot 20 and the firearm barrel 44 thus eliminating any vibration disruption in the trajectory of the Broadhead Bullet alternate 34. The circular sabot 26 parts are ejected from the pivoting blades sabot recess 32 portion of the pivoting blades 6 as the Broadhead Bullet alternate 34 travels through the target material 42.

FIG. 16 shows the Broadhead Bullet alternate 34 with the circular sabot 26 and wad-sabot-sabot 20 inside of a shot shell 38, as it would be before being shot. The shot shell 38 here is semi transparent to better illustrate the construction of the Broadhead Bullet alternate 34 within the shot shell 38. Here the shell 38 contains powder charge 40, wad-sabot 20, and the Broadhead Bullet alternate 34 with the circular sabot 26.

FIG. 17 shows an exploded view of the Broadhead Bullet alternate 34 with circular sabot 26, powder charge 40, wad-sabot 20, and Broadhead Bullet alternate 34 all outside the confines of the shot shell 38.

FIG. 18 shows a cut-a-way view of a shotgun barrel 44 with the Broadhead Bullet alternate 34 with circular sabot 26, and wad-sabot 20 as they would be inside of a smoothbore shotgun barrel after being fired. Here the circular sabot 26 and the wad-sabot 20 are all connected to the Broadhead Bullet alternate 34 and are also in contact with the gun barrel 44 in a manner that will not allow the pivoting blades 6 and stationary blades 8 of the Broadhead Bullet alternate 34 to contact the gun barrel 44. The sabot-wad 20 is shown carrying the rear portion and the circular sabot 26 carrying the front portion of the Broadhead Bullet alternate 34 through the gun barrel 44 thus giving the alternate 34 maximum stability as it travels through the gun barrel 44.

FIG. 19 shows the Broadhead Bullet alternate 34 during the early stages of the pivoting blades 6 deploying with the pivoting blade tips 18 of the pivoting blades 6 in contact with the medium 42 as well as the stationary blades 8 and stationary blade scoop 10. The pivoting blades 6 are being forced into deployed position by the target medium 42 as the Broadhead Bullet alternate 34 begins to travel through the target medium 42. The pivoting blades 6 here also pivot on the blade pivot 12 to which they are attached, the blade stop 14 here has not yet contacted the pivoting blades 6. The circular sabot 26 here has separated into two pieces, each piece still attached to an individual pivoting blade 6.

FIG. 20 shows the Broadhead Bullet alternate 34 as it is entirely inside the target medium 42. Here the pivoting blades 6 are in the fully deployed position, the rear end base of each pivoting blade 6 resting against the blade stop 14 which support the pivoting blades 6 as the Broadhead Bullet alternate 34 travels through the target medium 42. The two circular sabot 26 parts here have been ejected from the pivoting blades 6 by and remain outside of the target medium 42. The stationary blades 8, pivoting blades 6, and stationary blade scoop 10 cut a path through the target medium 42 as the Broadhead Bullet alternate 34 travels through the target medium 42.

OPERATION OF INVENTION

Alternate Embodiment: FIGS. 12-20

The Broadhead Bullet alternate 34 embodiment is illustrated in FIGS. 12-20. The Broadhead Bullet alternate 34 is intended to function within a 12 Gauge shotgun with a smooth bore barrel, as would current 12 Gauge shot shells for smooth bore barrels on the consumer market today. FIG. 12-15 details the Broadhead Bullet alternate 34 in the in flight with the pivoting blades 6 in their closed position. Here the pivoting blades 6 are rotated forward on the blades 6 blade pivot 12 and the blade edges 30 rest on or near shaft 4. The pivoting blade tips 18 are positioned at the front of the Broadhead Bullet alternate assembly 34 such that the tips 18 are in alignment with the central horizontal axis of the shaft 4. The rear portions of the pivoting blades 6 are attached to the blade pivot 12 where both pivoting blades 6 reside side by side along the horizontal axis of the blade pivot 12. This construction allows for a slight angular bias between the rear portions of the pivoting blades 6 and pivoting blade tips 18. This angular bias will impart a rotational force to the Broadhead Bullet alternate 34 during its trajectory by directing the air around the pivoting blades 6 thus imparting a resistance to the Broadhead Bullet alternate 34 to spin around its central horizontal axis. This spin will create a more stable flight trajectory for the Broadhead Bullet alternate 34 as would the spin a traditional bullet fired from a rifled barrel would stabilize the round. Fixed Blades 8 reside at 90 degrees from either of the pivoting blades 6 position on shaft 4 and may also have an angular bias such as to impart a rotational force to the Broadhead Bullet alternate 34.

The circular sabot 26 is constructed from two separate and identical pieces that are attached to the outer most edge of the pivoting blades 6 and contact the stationary blades 8 such that the stationary blades 8 provide structural support to the sabot 26 during flight. The circular sabot 26 pieces are constructed from a plastic like material that will not damage the inside surface of the firearm barrel 44 as well as to provide a contact surface with the characteristic of having less friction than would the pivoting blades 6 and stationary blade 8 produce against the firearm barrel 44. The circular sabot 26 provides a barrier between both the stationary blades 8 and the pivoting blades 6 and the inside surface of the firearm barrel such that the Broadhead Bullet 2 will not experience any sizable gap between the sabot 26 and the firearm barrel thus eliminating any vibration disruption as it travels through the gun barrel 44. The circular sabot 26 may have an airfoil design to impart a low drag characteristic while the Broadhead Bullet alternate 34 is in flight while also creating a stabilizing force onto the Broadhead Bullet alternate 34 such that the trajectory of the Bullet alternate 34 will be more true to its intended trajectory and less susceptible to outside disrupting forces.

FIG. 16 shows the Broadhead Bullet 2 inside of a shot shell 38, as it would be before being shot. The shot shell 38 here is semi transparent to better illustrate the construction of the Broadhead Bullet alternate 34 within the shot shell 38. Here the shell 38 contains powder charge 40, wad-sabot 20, and the Broadhead Bullet alternate embodiment 34.

FIG. 17 shows an exploded view of the Broadhead Bullet alternate 34 with the shot shell 38, powder charge 40, Wad-sabot 20, and Broadhead Bullet alternate 34.

FIG. 18 shows a cut-a-way view of a shotgun barrel 44 with the Broadhead Bullet alternate 34 and the wad-sabot 20, as they would be after firing the round from the shotgun shell 38. Here the circular sabot 26 and the wad-sabot 20 are connected to the Broadhead Bullet alternate 34 and are also in contact with the gun barrel 44 in a manner that will not allow the pivoting blades 6 and stationary blades 8 to contact the gun barrel 44. Pivoting blade sabot recess 32, shown in FIG. 20, prevent the circular sabot 26 from sliding reward of the Broadhead Bullet alternate 32 during its travel through the gun barrel 44. When the Broadhead Bullet alternate 34 is fired, the primer ignites the powder charge 40 after the primer is struck by the guns firing pin. As the powder 40 burns the expanding gasses produced pushes the wad-sabot 20 against the Broadhead Bullet alternate 34, which is in turn pushed out of the shell 38 and into the firearms barrel 44. During this stage the wad-sabot 20 and circular sabot 26 guides the Broadhead Bullet alternate 34 through the firearm barrel 44 providing stabilized travel while preventing the pivoting blades 6 and stationary blades 8 from contacting the gun barrel 44. As the Broadhead Bullet alternate 34 exits the firearm barrel 44 the wad-sabot 20 is ejected rearward from the Broadhead bullet alternate 34 leaving only the Bullet alternate 34 and circular sabot 26 on its intended trajectory towards the target.

The Broadhead Bullet Sabot assembly 34 here mimics the trajectory of an arrow fired from a high-powered compound bow, depending on the size of the powder charge 40. This intended trajectory for the Broadhead Bullet alternate 34 thus allows for it to be used in areas where the type of projectile is limited to short ranges due to high-density area hunting. The Broadhead Bullet Sabot assembly 34 is also intended for use in one of the most popular firearms, the 12 Gauge shotgun, without modifications to the shotgun. A sighting system specifically calibrated to the trajectory of the Broadhead Bullet alternate 34 may be incorporated to compensate for the shortened travel of the Bullet alternate 34.

FIG. 19 shows the Broadhead Bullet alternate 34 in the early stages of striking the target medium 42, the pivoting blade tips 18 are in contact with the medium 42 as well as the stationary blades 2 and stationary blade scoop 10. As the shaft 4 travels through the target medium the pivoting blade tips 18 catch the target material 42 preventing the pivoting blades 6 from penetrating the target material 42. The pivoting blade tips 18 slide along the external surface of the target material and away from the central horizontal axis of the shaft 4, which deploys the pivoting blades 6 into a semi deployed stage. The circular sabot 26 is constructed from two identical pieces that fit together while the Broadhead Bullet alternate 34 is inside of the shot shell 38 and while in flight. The circular sabot 26 creates a stabilizing effect onto the Broadhead Bullet alternate 34 while in flight as well as to act as a sabot between the Bullets alternate 34 and the gun barrel 44. Here in FIG. 19 the two pieces of the circular sabot 26 separate as the pivoting blades 6 achieve semi deployed stage. Here the circular sabot 26 pieces remain attached to the pivoting blades 6 in a releasable manner that will be shown in FIG. 20.

FIG. 20 shows the Broadhead Bullet alternate 34 as the entire assembly has entered the target medium 42 minus the circular sabot 26 pieces, which are ejected from the pivoting blade sabot recess 32 portions of the pivoting blades 6. The pivoting blades 6 have achieved the fully deployed position and rest against blade stop 14 in such a way the blade stop 14 stops the pivoting deployment action of the pivoting blades 6 as well as to provide a strengthened rest to support the pivoting blades 6. The stationary blades 8, pivoting blades 6, and stationary blade scoop 10 cut a path through the target medium 44 as the Broadhead Bullet alternate 34 travels through the target medium 42.

The invention claimed is:

1. A new type of firearm projectile for use in a smoothbore barrel firearm comprising:

a shaft having a length and a circumference;

a penetrating tip, said penetrating tip is affixed to one end of said shaft and has a shape to initiate the penetration of said firearm projectile into target material;

stationary blades affixed to said shaft and/or said penetrating tip whereby said stationary blades are oriented opposite from each other, said stationary blades have cutting edges facing towards said penetrating tip;

a stationary blade sabot affixed to the outer most edge of each said stationary blade whereby said stationary blade sabots provide a barrier between said stationary blades and a firearm barrel, said stationary blade sabots are releasable from said stationary blades when said firearm projectile enters the target material;

two pivoting blades attached to the other end of said shaft by a pivot blade shaft, said pivoting blades are oriented opposite from each other and adjacent to said shaft, said pivoting blades are able to pivot outwardly at said pivot blade shaft when front tips of said pivoting blades contact said target material;

a pivot stop positioned at the other end of said shaft behind said pivot blade shaft whereby said pivot stop terminates the pivoting deployment of said pivoting blades when said pivoting blades reach a full deployment position whereby said pivoting blades cutting edges are oriented towards said target material;

pivoting blade sabots affixed to the front and outer tip portion of each of said pivoting blades whereby said pivoting blade sabots provide a barrier between said pivoting blades and the firearm barrel, whereby said pivoting blade sabots aid said pivoting blades to deploy, whereby said pivoting blade sabots are releasable from said pivoting blades upon full deployment;

a wad to provide a barrier between powder charge and the projectile, said wad functions as a sabot for the rear portion of the projectile whereby said wad holds the rear portion of the projectile and provides a barrier between said gun barrel and said firearm projectile, said wad is releasable from said firearm projectile when the projectile exits the firearm barrel; and said firearm projectile, the sabots, the wad, and said powder charge reside inside of a shot shell, said shot shell is sized to fit within said firearm barrel.

2. The firearm projectile from claim 1 further including the rear portion of said pivoting blades at said pivoting blade shaft are offset from the center horizontal axis of said shaft and the front tips of said pivoting blades are in alignment with the horizontal axis whereby the slight angular difference in said pivoting blades relative to the horizontal axis of said shaft imparts a stabilizing spin to the projectile while in flight; and said stationary blades are also slightly angularly biased whereby said stationary blades also impart a stabilizing spin to the projectile in concert with said pivoting blades.

3. A new type of firearm projectile for use in a smoothbore barrel firearm, comprising:

a shaft having a length and a circumference;

a penetrating tip, said penetrating tip is affixed to one end of said shaft and has a shape to initiate the penetration of said firearm projectile into target material;

stationary blades affixed to said shaft and or said penetrating tip whereby said stationary blades are oriented opposite from each other, said stationary blades have cutting edges facing towards said penetrating tip;

two pivoting blades attached to the other end of said shaft by a pivot blade shaft, said pivoting blades are oriented opposite from each other and adjacent to said shaft, said pivoting blades are able to pivot outwardly at said pivot blade shaft when front tips of said pivoting blades contact said target material;

a pivot stop positioned at the other end of said shaft behind said pivot blade shaft whereby said pivot stop terminates the pivoting deployment of said pivoting blades when said pivoting blades reach a full deployment position whereby said pivoting blades cutting edges are oriented towards said target material;

a circular sabot consisting of at least two pieces and attached to said pivoting blades whereby the circular sabot pieces remain affixed to said pivoting blades when said pivoting blades are in the closed position and are releasable when said pivoting blades are in the full deployment position, said circular sabot provides a barrier between the pivoting blades, stationary blades, and the firearm barrel;

a wad that provides a barrier between a powder charge and the projectile and said wad functions as a sabot for the rear portion of the projectile whereby said wad holds the rear portion of the projectile and provides a barrier between said gun barrel and said firearm projectile, said wad is releasable from said firearm projectile when the projectile exits the firearm barrel; and said firearm projectile, the sabots, the wad, and said powder charge reside inside of a shot shell, said shot shell is sized to fit within said firearm barrel.

4. The projectile from claim 3 further including said circular sabot has an airfoil shape whereby said circular sabot provides stabilization to said firearm projectile during flight.

5. The projectile from claim 3 further including said pivoting blades have front tips that are wider in thickness than the rest of said pivoting blades whereby the increase in thickness aids in the deployment of said pivoting blades when the projectile impacts the target material.

6. The firearm projectile from claim 3 further including the rear portion of said pivoting blades at said pivoting blade shaft are offset from the center horizontal axis of said shaft and the front tips of said pivoting blades are in alignment with the horizontal axis whereby the slight angular difference in said pivoting blades relative to the horizontal axis of said shaft imparts a stabilizing spin to the projectile while in flight; and said stationary blades are also slightly angularly biased whereby said stationary blades also impart a stabilizing spin to the projectile in concert with said pivoting blades.

7. The firearm projectile from claim 6 further including said circular sabot has an airfoil shape whereby said circular sabot provides stabilization to said firearm projectile during flight.

8. The projectile from claim 6 further including said pivoting blades have front tips that are wider in thickness than the rest of said pivoting blades whereby the increase in thickness aids in the deployment of said pivoting blades when the projectile impacts the target material.

9. The projectile from claim 8 further including said circular sabot has an airfoil shape whereby said circular sabot provides stabilization to said firearm projectile during flight.

* * * * *